United States Patent [19]

Johnson

[11] 3,983,637

[45] Oct. 5, 1976

[54] PROCESS FOR DRYING ENCAPSULATED FISSILE AND NON-FISSILE BODIES

[75] Inventor: Charles R. Johnson, Lynchburg, Va.

[73] Assignee: The Babcock & Wilcox Company, New York, N.Y.

[22] Filed: May 12, 1975

[21] Appl. No.: 576,766

[52] U.S. Cl. ..... 34/15; 34/92; 176/68; 264/.5

[51] Int. Cl.[2] ..... F26B 5/04

[58] Field of Search ..... 34/15, 92, 104, 107; 264/.5; 423/261; 176/68

[56] References Cited

UNITED STATES PATENTS

| | | | |
|---|---|---|---|
| 3,299,524 | 1/1967 | Jacobs | 34/15 X |
| 3,521,372 | 7/1970 | Johansson | 34/15 |
| 3,890,424 | 6/1975 | Davies | 34/15 |

*Primary Examiner*—John J. Camby
*Attorney, Agent, or Firm*—Joseph M. Maguire; Vincent M. Fazzari; Jack P. Sinnott

[57] ABSTRACT

A process for removal of moisture from fissile and non-fissile bodies which are encapsulated in hollow rods comprising perforating the rod, subjecting the rod to a reduced pressure environment, filling the rod with a dehydrating reagent and adjusting the temperature and pressure to bring about vaporization of the dehydrating reagent-water mixture. After cooling in a dry inert gas atmosphere, the rod is removed from the environment and the perforation is sealed.

19 Claims, 3 Drawing Figures

PROCESS FOR DRYING ENCAPSULATED FISSILE AND NON-FISSILE BODIES

BACKGROUND OF THE INVENTION

This invention relates to decontamination techniques and, more particularly, to a method and apparatus for evacuating water from within nuclear reactor fuel rods and the like.

In order to function, nuclear reactors for power, research, or for any other purpose must have a sufficient concentration of fissionable material to sustain an essentially continuous sequence of fission reactions. This fissionable material, of which uranium dioxide ($UO_2$) is typical, frequently is compacted into small pellets which are loaded into slender metal fuel rods. Other rods within the reactor core may contain non-fissile materials which are known as poisons. Such rods may often be more than six feet in length. After the pellets are loaded, the fuel rods are each capped and welded closed thus encapsulating the "fuel" material.

Removal of contaminants from the fuel rods has been accomplished by drilling a small hole in the fuel rod surface and applying a vacuum to the hole to purge the contaminants e.g. moisture and gases, from within the rod. It also might be necessary to pressurize the fuel rod by introducing an inert gas into the rod interior through the small hole after the contaminants are evacuated. The small hole may be sealed before the rod is removed from the controlled environment.

It has been found in some instances that the application of a vacuum to the small hole in the fuel rod is not adequate to evacuate all of the contaminants from within the rod. The remaining contaminants can lead to inefficient nuclear fuel consumption as well as swollen, burst or collapsed fuel rods.

SUMMARY OF THE INVENTION

Unsatisfactory features of this vacuum purging system are overcome to a large extent, through the practice of the instant invention. Illustratively, after the vacuum has been applied to the small hole in the fuel rod to purge the contaminants from within the fuel rod, alcohol is admitted to the rod interior through the same hole. The alcohol absorbs the remaining moisture and other contaminants. The contaminated alcohol is then purged from the rod interior through the same hole by regulation of the environment within a retort. The retort is then backfilled with a dry inert gas and allowed to cool to ambient temperature. After cooling, the rods are pressurized and the small hole is sealed.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF THE PREFERRED EMBODIMENTS OF THE INVENTION

In practicing the present invention, one may find reference to the accompanying drawings useful. It should be understood that the reference to fuel rods throughout the disclosure is intended to encompass those rods containing a true fuel as well as a poison or a mixture thereof.

Figure 1:
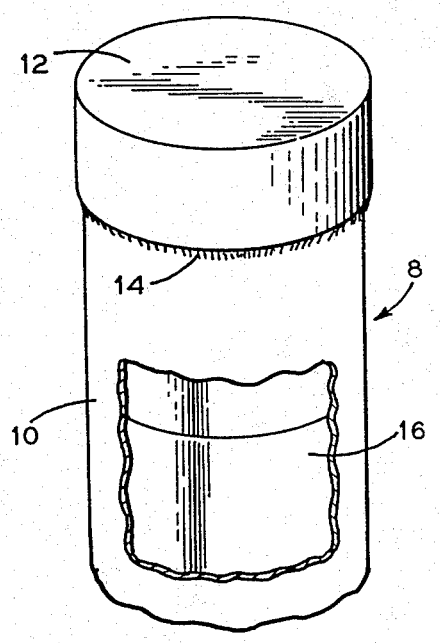
FIG. 1 depicts a portion of the encapsulated fuel rod with a section cutaway to show the fuel pellets encased therein.

FIG. 1 shows the end section and surrounding area of fuel rod 8 with a portion of the hollow cylinder 10 cutaway showing fuel pellets 16 encased in fuel rod 8. Hollow cylinder 10, which may be in excess of 6 feet in length and approximately ½ inch diameter is capped by end cap 12 which is firmly affixed to hollow cylinder 10 by weld 14. Although throughout this description, the fuel pellets 16 will be referred to as $UO_2$ pellets, it is to be understood that reference to the pellets is to include the fuel in the powdered form and may be any of the other fuels which are used in nuclear reactors or power generators as long as they meet the criteria to be defined hereinafter. Examples of such fuels and poisons are the reactive thorium, uranium and plutonium compounds as well as boron carbide in alumina, boron carbide powders, zirconia, hafnia, gadolinia and any other high cross section rare earth oxide or mixture thereof.

Figure 2:
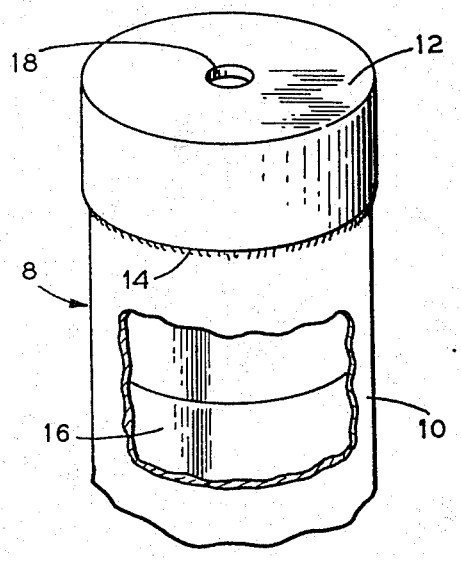
FIG. 2 is similar to FIG. 1, but shows the perforation in a preferred location.

FIG. 2 shows the fuel rod of FIG. 1 with a perforation 18 produced in end cap 12. Such perforation may be produced by a laser beam or by any conventional drilling means. The perforation is preferably located in the end cap but may be placed anywhere in the rod. Furthermore, numerous perforations may be employed but in the preferred method of practice, one perforation is used. A diameter of 0.01 inch is of suitable dimension for the hole 18 in the fuel rod 8.

Figure 3:
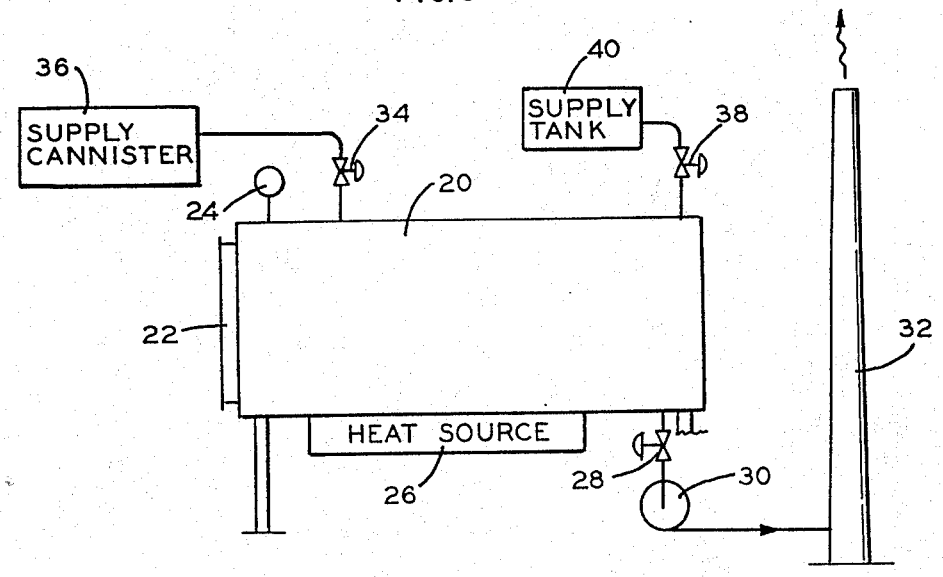
FIG. 3 is a schematic showing an arrangement of apparatus useful in practicing the present invention.

FIG. 3 depicts an arrangement of apparatus which can be used in practicing the invention. The perforated rod is to be placed in retort 20 through pressure seal door 22. The retort is designed to withstand a vacuum of less than 1 psia which is the actual gage pressure + 14.7 psi. The retort unit is also equipped with pressure gage 24 and heat source 26. A pipeline with valve means 28 connects the retort to vacuum pump 30. Any known commercial vacuum pump is quite suitable for this process assignment. The discharge line of the vacuum pump connects to a stack 32, or where necessary, to recovery equipment (not shown). Feeding the retort 20 is a supply cannister 36 of the dehydrating reagent. Interposed between the retort and supply cannister is valve means 34, which like valve means 28 may be operated manually or automatically. Also in connection with retort 20 is inert gas source supply tank 40 separated from the retort by valve means 38.

In using the above-described apparatus, the sequence of operation in practicing this invention is as follows. The perforated rod or rods, are placed in the retort and the pressure seal door is secured. Valve means 28 is then set at an opened position and vacuum pump 30 is started. The retort is evacuated preferably to less than 1 psia. Of course, the inside of the rod will also experience the effects of the evacuation and the vapor will be withdrawn from within the rod. In any case, upon reaching the desired degree of evacuation as indicated by pressure gage 24, valve means 28 is closed and vacuum pump 30 may be shut off. Subsequently, valve means 34 is moved to an open position and retort 20 is backfilled with a dehydrating reagent, alcohol for example, from supply cannister 36. The actual delivery of the reagent may be accomplished by transport means (not shown) which would vary depending on the physical state of the dehydrating reagent. Preferably, the dehydrating agent will be in the vapor form when in the retort. The retort should be filled with dehydrating reagent until the pressure is in excess of 5 psia before shutting valve 34. Such a condition will force the reagent through the perforation of the fuel rods and cause it to contact the solid fuel phase. The dehydrating agent will, by its nature, readily sorb the moisture from within the fuel rod and from within the fuel material. Heat source 26, which is preferably indirect in nature and may be electrical in variety, such as Chromolox Strip Heating Elements is activated so as to raise the temperature within the retort to in excess of 100°C. Such temperature will insure vaporization of the water-dehydrating agent solution no matter what percent moisture was contained in the fuel originally. This combination of temperature and pressure conditions is maintained for a sufficient period of time to effect complete vaporization of the solution. This period of time may vary somewhat depending on the nature of the dehydrating agent.

Vaporization having been completed, valve means 28 is opened and vacuum pump 30 again evacuates the retort 20. The exhaust is preferably directed to a condenser (not shown) or other types of treating equipment (not shown) since it contains the dehydrating reagent. Following evacuation, valve means 28 is closed, the vacuum pump 30 is shut down and the retort is flooded with a dry inert gas such as helium, from supply tank 40 via valve means 38 which is opened subsequent to the shutdown of pump 30. The gas is backfilled into the retort by the pressure differential between the pressurized gas in the supply tank and the evacuated atmosphere in the retort. The inert gas is allowed to backfill the retort until atmospheric pressure is achieved before valve means 38 is closed. The retort and its contents are allowed to cool down to ambient temperature. At such time, the rods are removed, and pressurized in accordance with the teachings of Heer et al. as disclosed in their U.S. Pat. No. 3,774,010, entitled *Pressurization of Fuel Rods by Laser Drilling and Sealing*, with an issue date of Nov. 20, 1973 also assigned to the assignee of the present invention. The small hole in the cap is then quickly closed so as to minimize the possibility of the fuel absorbing any moisture from the surrounding environment.

As previously mentioned, the fuel material may be pelletized or powdered in form and may be composed of any of the materials commonly employed in such operations. One positive requirement of the fuel is that it be inert with respect to the dehydrating reagent employed. In the preferable embodiment of the present invention, one would employ a dehydrating reagent such as methanol or acetone. Also, it is preferable that the dehydrating reagent be in the gaseous state when in the retort. Of course, the invention may be practiced with the dehydrating reagent in the liquid phase while in the retort in which case, additional pumping and valve means may be required.

Other dehydrating reagents may be employed in the practice of this invention. Low boiling alcohols including, but not necessarily limited to ethyl, propyl, isopropyl, butyl, sec-butyl, and tert butyl all may be used. Other ketones including, but not necessarily limited to methyl-ethyl ketone, methyl n-propyl ketone, diethyl ketone and biacetyl can also be used. Mixtures of the above may also be employed if circumstances so dictate. Other reagents that in combining with water act to produce a solution with a boiling point lower than that of water can be utilized.

The dry inert gas may be one selected from the group consisting of Helium, Neon, Argon, Krypton, Xenon and Radon. It has also been found that Nitrogen and other gases which are relatively inert under the process conditions are of use in practicing this invention.

One will appreciate that subsequent to evacuating the vaporized dehydrating reagent-moisture mixtue from the retort there may be some variation in the additional steps of the process. For example, the rods may be sealed before cooling within the retort or may be sealed before backfilling the retort with the dry inert gas to prevent subsequent oxidation of the rod material. Where the requirement is for a pressurized fuel rod, the rod may be pressurized with an inert gas and then sealed while in the retort.

I claim:

1. A method for drying moisture containing bodies encapsulated in a hollow rod comprising:

producing at least one perforation in the hollow rod, placing the rod in a sealed retort, evacuating the air from the retort and hollow rod, backfilling the retort with a fluid dehydrating reagent so as to combine the reagent with the moisture in the bodies, and then vaporizing the dehydrating reagent-moisture mixture in the retort.

2. A method as in claim 1 wherein the vaporized and dehydrating reagent-moisture mixture is evacuated from the retort.

3. A method as in claim 2 wherein the retort is backfilled with a dry inert gas subsequent to the evacuation of the reagent-moisture mixture.

4. A method as in claim 1 wherein the dehydrating reagent-moisture mixture is vaporized by the application of heat.

5. A method as in claim 4 wherein the retort is allowed to cool to ambient temperature.

6. A method as in claim 5 wherein the perforated rod is subsequently removed from the retort, pressurized and sealed.

7. A method as in claim 1 wherein the dehydrating reagent is in the gaseous state when introduced into the retort.

8. A method as in claim 6 wherein the dehydrating reagent is in the gaseous state when introduced into the retort.

9. A method as in claim 1 wherein each perforation is approximately 0.01 inch in diameter.

10. A method as in claim 6 wherein each perforation is approximately 0.01 inch in diameter.

11. A method as in claim 3 wherein the dry inert gas is one selected from the group known as the Noble Gases.

12. A method as in claim 3 wherein the dry inert gas is Nitrogen.

13. A method as in claim 1 wherein the dehydrating reagent is a low boiling alcohol.

14. A method as in claim 1 wherein the dehydrating reagent is a low boiling ketone.

15. A method as in claim 13 wherein the dehydrating reagent is methanol.

16. A method as in claim 14 wherein the dehydrating reagent is acetone.

17. A method as in claim 2 wherein the rods are sealed within the retort.

18. A method as in claim 2 wherein the rods are pressurized and sealed within the retort.

19. A method as in claim 17 wherein the rods are cooled and sealed within the retort.

* * * * *